US005550333A

United States Patent [19]

Whiteman, Jr.

[11] Patent Number: 5,550,333

[45] Date of Patent: Aug. 27, 1996

[54] REDUCED NOISE TRAILERABLE ENGINE

[75] Inventor: Marvin E. Whiteman, Jr., Boise, Id.

[73] Assignee: Whiteman Industries, Inc., Boise, Id.

[21] Appl. No.: 370,727

[22] Filed: Jan. 10, 1995

[51] Int. Cl.[6] ..... F01N 1/10

[52] U.S. Cl. ..... 181/204; 362/61; 362/192

[58] Field of Search ..... 181/200, 202, 181/204; 362/61, 192; 312/100

[56] References Cited

U.S. PATENT DOCUMENTS

| | | | |
|---|---|---|---|
| Re. 30,000 | 5/1979 | Loffler et al. | 362/61 X |
| 3,642,092 | 2/1972 | Cederbaum | 181/204 |
| 3,666,042 | 5/1972 | Cederbaum | 181/204 |
| 3,815,965 | 6/1974 | Ostwald | 181/204 X |
| 4,181,929 | 1/1980 | Barber et al. | 362/192 |
| 4,385,678 | 5/1983 | Cederbaum | 181/204 |

*Primary Examiner*—Khanh Dang
*Attorney, Agent, or Firm*—Frank J. Dykas

[57] ABSTRACT

A trailerable engine housing 10 for a heat and noise emitting engine 68 is provided, formed of an open topped container having pyramidally shaped end walls 22, 24, side walls 14, 16, and a base plate 42. The open topped container is divided into two separate enclosures by an enclosure baffle 58. A pair of vent panel 28, 30, are held in angled spaced relationship to the pyramidal side edges of the end walls to form an air induction vent hole open to one enclosure and a hot air exhaust hole open to the other. Inducted air is transferred from one enclosure to the other through an enclosure baffle vent hole. Sonic energy may not pass through either the induction air or the hot air exhaust vent holes without first being reflected off a surface within the engine housing.

12 Claims, 3 Drawing Sheets

REDUCED NOISE TRAILERABLE ENGINE

BACKGROUND OF THE INVENTION

1. Technical Field

This invention generally relates to trailerable engine housings having reduced noise characteristics, and more specifically to trailerable engine housings of unibody construction with cross flow ventilation through vents which obstruct or impede transmission of sound.

2. Background

Trailerable engine housings are used as power sources at remote locations. Gas or diesel engines are usually mounted upon a trailer frame, together with their accessory units such as cooling or radiator systems, fuel tanks, and associated electrical systems, and are used to drive a power source, such as, for example, an electrical generator, hydraulic pump, air compressor, or water pump. They are most commonly used in civil construction applications such as road or building construction projects where regular utility services may not be readily available. Examples of such applications include trailerable light towers used for illumination of road construction projects where connection to electrical power lines would be difficult or impossible to achieve. Another example would be the use of a trailerable engine housing as a source of compressed air for a pneumatic jack hammer. This list of different applications would be practically endless, and no attempt will be made to provide a complete list. But at a minimum it would include the power sources enumerated above.

They all have one thing in common. They all have a noise and heat emitting engine, usually gas or diesel fueled.

The typical prior art trailerable engine housing includes a frame defining a platform which is supported by a sprung single axle, and a trailer hitch or tongue assembly. The engine and the driven power source, together with their associated systems, are mounted atop the frame, and in most cases, some sort of a cowling is provided for weather and mechanical and electrical system protection.

The gas or diesel engines may be either water cooled, in which case a radiator, with air flow across it, must be provided, or air cooled, heat exchanging cooling fins must be provided with a constant source of cooling air flow. As a result, the prior art cowlings are designed to be well ventilated, so as to provide adequate air flow to keep the engine, and for that matter, the power source which also generates heat, cooled to within the designed operating temperature range.

These engines, and for that matter the attached power source, also generate noise. If the noise is loud enough it becomes an environmental hazard for a number of different reasons. The engine noise may impede communications between workers, and it may become an annoying distraction, since listening to a roaring engine over an eight to twelve hour work day may become quite annoying and even medically harmful. Reducing the operating noise level requires substantial sound baffling, the provision of which would conflict with the need for a well ventilated engine housing. If one were to design a sound reducing engine housing which encases the engine to reduce emitted noise levels, the engine will overheat since air flow will be reduced.

In addition to the conflicting design criteria between ventilating air flow and noise reduction, there is a third problem with the prior art trailerable engine housing. It is the construction technique used in the prior art, namely use of the conventional platform trailer frame atop of which everything else is set. Like the antiquated automobile construction techniques of old, where a separate vehicle frame was provided and to which everything else was bolted, welded or otherwise attached, the prior art trailerable engine housing has a high profile and a high center of gravity. This causes problems with trailer stability, both during transport, and perhaps just as importantly, when the trailerable engine housing serves as the weighted base for a light tower, or anything else that extends upward and is exposed to the wind, and thus subject to being blown over in the wind.

Accordingly what is needed is a trailerable engine housing that is stable, provides a lowered center of gravity, and is constructed in such a manner to provide both adequate cooling air flow and noise reduction.

DISCLOSURE OF INVENTION

These objects are achieved in a noise reducing trailerable engine housing which includes an open topped container which is formed using unibody design and manufacturing techniques of: a first end wall; a second end wall; a first side wall; a second side wall, and base plate. The base plate is formed of a single piece of steel plate. Structural rigidity is provided by base plate lips. The base plate essentially serves as a substitute for the trailer platform frame of the conventional prior art trailer.

The first and second side walls, and the first and second end walls are fabricated of plate steel, either separately as individual pieces which are then welded together, or as a single stamping which is then bent to form the rectangular structure. Rigidity of the side walls is increased by the formation of side wall lips.

U-shaped spring shackles are welded to the underside of the base plate to provide attachment points for springs, which are attached by means of U-bolt assemblies to a trailer axle and wheels. Wheel fenders of conventional design and are also attached to the side walls. Also included are conventional trailer lights and the associated electrical wiring required to connect them to a towing vehicle.

The first and second end walls are formed having a generally pyramidal upper portion and top panel support lips and reciprocally angled vent panel support lips. Each of these lips serves to enhance structural rigidity of the end wall. However in addition to enhancing structural rigidity, the top panel support lips are used as attachment points for a top panel, which when bolted or welded on completes the rigid structural portion of the engine housing.

An enclosure baffle, formed of a dividing wall and an enclosure baffle end wall, is used to divide the interior volume of the engine housing into two separate enclosures. The dividing wall and enclosure baffle are each configured in size and shape to conform to the elevational height and angle of the end walls, so that when the top panel is attached, and the first and second vent panels are lowered into position, each of the two enclosures is separated from the other, so as to provide for cross flow ventilation and to prevent recirculation of hot air within the engine housing. In the preferred embodiment, a single dividing wall vent hole is provided in the dividing wall, however a plurality of similar vent holes, depending upon the required equipment configuration for varying applications or uses, could be provided in either or both the dividing wall and the enclosure baffle end wall.

The top panel is formed of steel plate, and may be either bolted or welded to the top panel support lips. Attached, by means of piano hinges, to the sides of the top panel are first and second vent panels. Each is provided with vent panel extensions and vent panel extension support lips, which serve to hold the vent panels extended out from corresponding side walls in order to form an air induction vent hole and a air exhaust vent hole. A third vent panel extension and vent panel extension support lip are provided for contact with the upper edges of the enclosure baffle end wall to further maintain the separation between the two separate enclosures defined with the engine housing.

The vent panels, together with their attached vent panel extensions are configured in size to define an air induction vent hole and a hot air exhaust vent hole such that no line drawn parallel to the base plate may pass through the air induction vent hole or the hot air exhaust vent hole. In this manner, no sonic wave or energy emanating from a noise emitting engine or power source contained with the engine housing can pass through either vent hole, without first bouncing off an interior surface of the engine housing. Thus, during engine operation, all sonic energy being emitted from the engine and the power source will encounter other sonic waves being reflected from surfaces within the engine housing, thus reducing the total amount of sonic energy being emitted from the engine housing.

Further noise reduction is accomplished by the use of sound absorption pads which are glued, or otherwise attached in a conventional and well known manner to the undersides of the vent panels and the interior surfaces of the enclosure within the engine housing in which the engine and power source are located.

The enclosure baffle is provided to prevent recirculation of air within the engine housing. The use of the enclosure baffle insures the only source of cooling air is through the air induction vent hole and that the only vent hole through which hot air can be exhausted is through the hot air exhaust vent hole. The engine receives its supply of combustion air through an air filter which draws air through a combustion air intake line which passes through the dividing wall. Engine exhaust air, passing through an exhaust pipe, also passes through the dividing wall into a muffler and out through the base plate to atmosphere.

Cooling air is drawn through the air induction vent hole and dividing wall vent hole by means of a cooling air fan.

The noise reducing trailerable engine housing is incorporated into a trailerable light tower. A longitudinal beam is attached to the upper surface of the base plate and a base plate tongue extension, and passes entirely through the engine housing. It serves both as the main structural member of the tongue assembly and also as a receiving member for a rear jack extension and a tongue jack extension. In a similar fashion, transversely oriented outrigger receiving beams are provided for use with telescoping outrigger jack assemblies. Each of the outrigger jack assemblies and the tongue and rear jack assemblies can be selectively retracted or extended, and locked in place by means of extension lock assemblies which are of conventional and well known design.

A telescoping light tower is provided together with lights. The telescoping light tower is supported in its vertical position by means of a light tower brace and light tower support brackets which are welded to the first end wall and the base plate tongue extension and thus become an integral part of the unibody constructed unit.

BEST MODE FOR CARRYING OUT INVENTION

Figure 1:
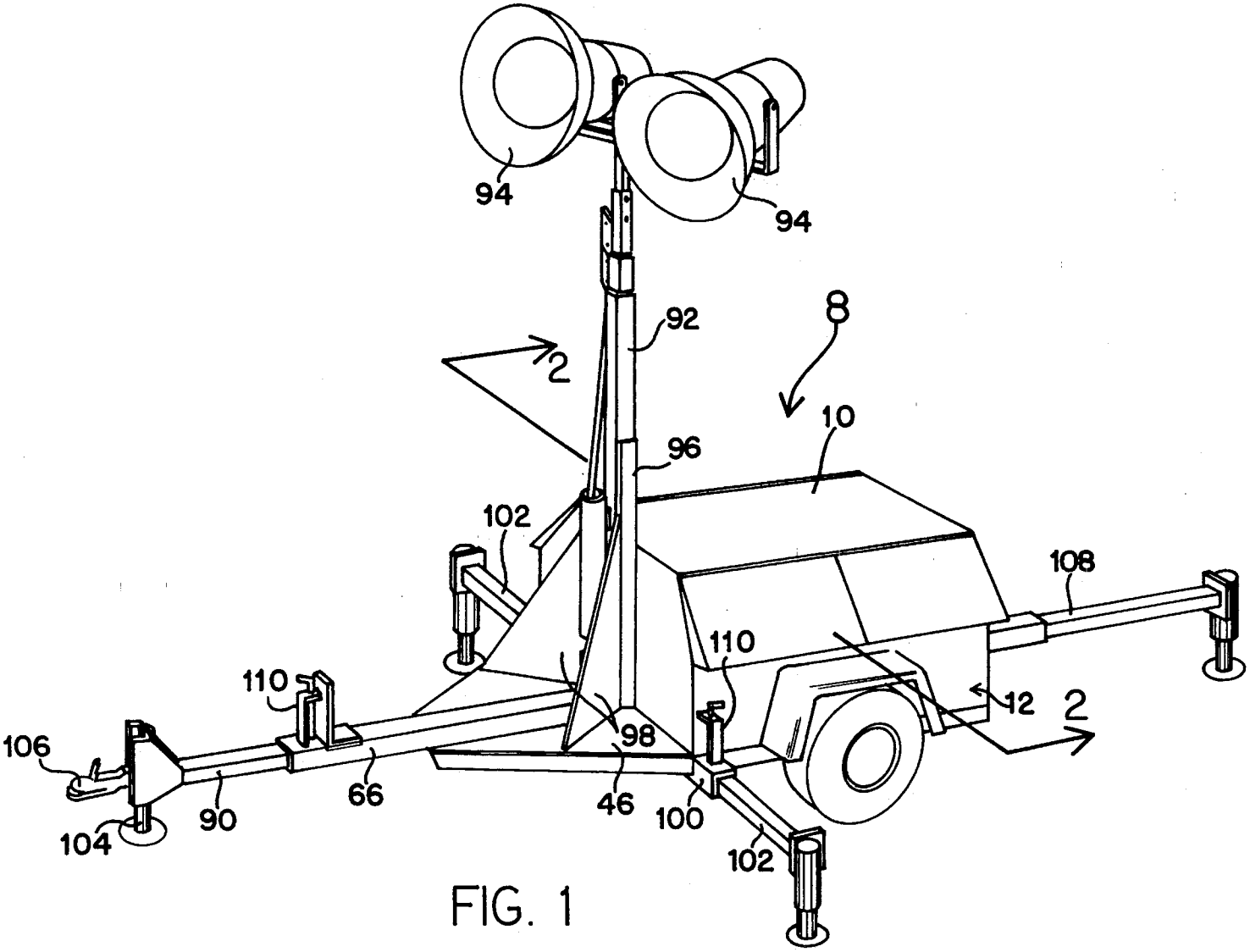
FIG. 1 is a perspective representational view of a trailerable light tower incorporating the noise reducing, trailerable, engine housing.

FIG. 1 discloses a trailerable light tower assembly 8 which incorporates my new noise reducing, trailerable, engine housing 10 as an integral part of light tower assembly.

It should be distinctly understood, that although this best mode section of the specification discloses the noise reducing trailerable engine housing in the context of a trailerable light tower, the principles of the invention are equally applicable to any and all other applications where a trailerable engine housing may be incorporated, including, but not limited to, trailerable generators, water pumps, hydraulic pumps and pneumatic pumps.

Figure 2:
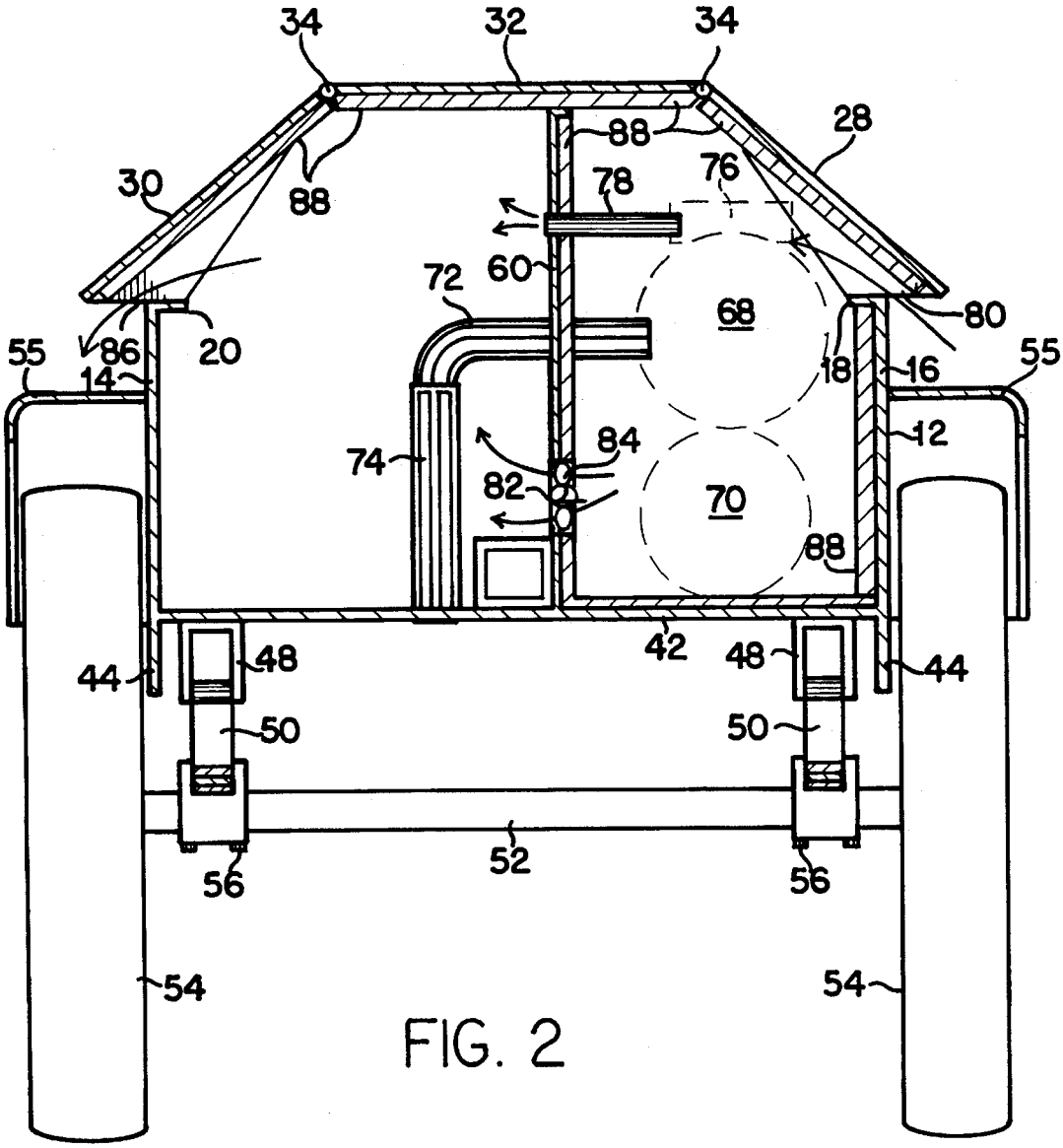
FIG. 2 is a sectional side view of the noise reducing, trailerable, engine housing taken along sectional plane line A—A of FIG. 1.
Figure 3:
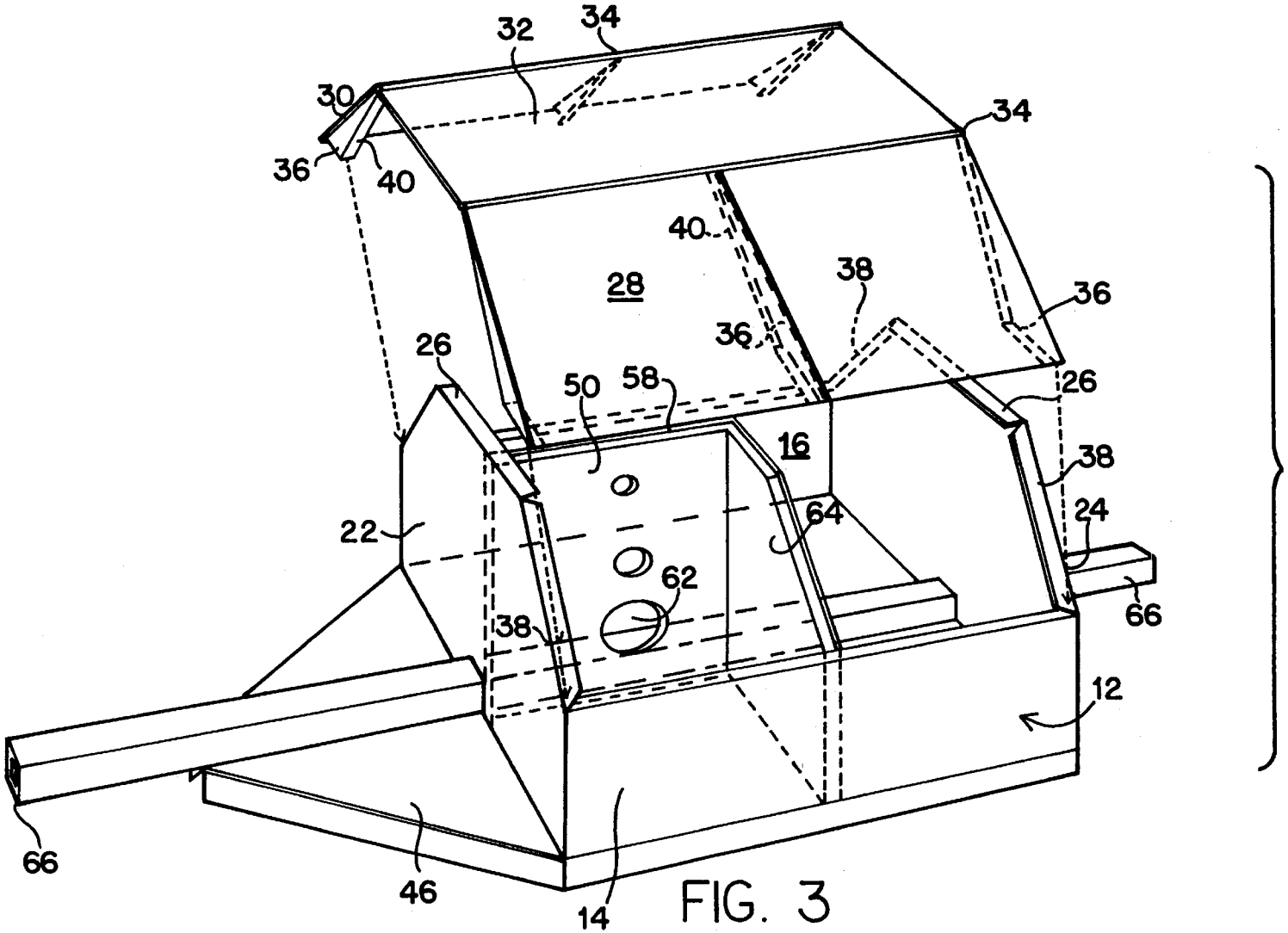
FIG. 3 is an exploded perspective representational view of the open topped container assembly and enclosure baffle assembly of the noise reducing, trailerable, engine housing.

As shown in FIGS. 2 and 3, noise reducing trailerable engine housing 10 includes open topped container 12 which is formed, using unibody design and manufacturing techniques of first end wall 22, second end wall 24, first side wall 14, second side wall 16, and base plate 42.

Base plate 42, together with base plate tongue extension plate 46, is, in the preferred embodiment, formed of a single piece of steel plate. Structural rigidity is provided by base plate lips 44. Base plate 42 essentially serves as a substitute for the trailer platform frame of the conventional prior art trailer. Use of base plate 42 reduces overall trailer height and thus lowers the center of gravity of the entire trailer. This can be of significance, especially in the trailerable light tower application as disclosed in this best mode section.

First and second side walls 14 and 16, and first and second end walls 22 and 24 are also fabricated of plate steel, either separately as individual pieces which are then welded together, or as a single stamping which is then bent to form the rectangular structure. Rigidity of the side walls is increased by the formation of side wall lips 18 and 20. In the preferred embodiment first and second side walls are attached to base plate 42 by means of welding the bottom edge portion of each side wall to base plate lip 44. This structure thus forms an open topped container.

U-shaped spring shackles 48 are welded to the underside of base plate 42, to provide, in a conventional and well known manner, attachment points for springs 50, which are in turn are attached by means of U-bolt assemblies 56 to trailer axle 52 and wheels 54. Wheel fenders 55 are of conventional design and are also attached to side walls 14 and 16 in a conventional and well known manner. Also included are conventional trailer lights and the associated electrical wiring required to connect them to a towing vehicle. However, since they play no part in the present invention, and are so well known, for clarity's sake they are omitted from the drawings.

As shown in FIGS. 2 and 3, first and second end walls 22 and 24 are formed having a generally pyramidal upper portion. They are also provided with top panel support lips 26 and reciprocally angled vent panel support lips 38. Each of these lips serve to enhance structural rigidity of the end wall. However in addition to enhancing structural rigidity, top panel support lips 26 are used as attachment points for top panel 32, which when bolted or welded on, in a conventional and well known manner, completes the rigid structural portion of the engine housing 10. Vent panel support lips 38 are used to support first and second vent panels 28 and 30 as will be later described.

An enclosure baffle 58, formed of dividing wall 60 and enclosure baffle end wall 64, is used to divide the interior volume of engine housing 10 into two separate enclosures. Dividing wall 60 and enclosure baffle 64 are each configured in size and shape to conform to the elevational height and angle of the end walls, so that when top panel 32 is attached, and first, and second vent panels 28 and 30 are lowered into position, each of the two enclosures is separated from the other. As will be later described, this is necessary to provide for cross flow ventilation and to prevent recirculation of hot air within engine housing 10. In the preferred embodiment, a single dividing wall vent hole is provided in dividing wall 60, however it should be apparent to those skilled in the art, a plurality of similar vent holes, depending upon the required equipment configuration for varying applications or uses, could be provided in either or both dividing wall 60 and enclosure baffle end wall 64.

Top panel 32, in the preferred embodiment, is formed of steel plate, and may be either bolted or welded to top panel support lips 26. Attached, by means of piano hinges 34, to the sides of top panel 32 are first and second vent panels 28 and 30. Each is provided with vent panel extensions 36 and vent panel extension support lips 40, which serve to hold vent panels 28 and 30 extended out from corresponding side walls in order to form air induction vent hole 80 and air exhaust vent hole 86 as shown in FIG. 2. A third vent panel extension 36 and vent panel extension support lip 40 is provided for contact with the upper edges of enclosure baffle end wall 64 to further maintain the separation between the two separate enclosures defined with engine housing 10.

Vent panels 28 and 30, together with their attached vent panel extensions 36 are configured in size to define air induction vent hole 80 and hot air exhaust vent hole 86 such that no line drawn parallel to base plate 42 may pass through air induction vent hole 80 or hot air exhaust vent hole 86. In this manner, no sonic wave or energy emanating from noise emitting engine 68 or power source 70 contained with engine housing 10, traveling in a straight line, can pass through either vent holes 80 or 86, without first bouncing off an interior surface of engine housing 10. Thus, during engine operation, all sonic energy being emitted from engine 68 and the power source 70, which in this preferred embodiment is electrical generator 70, will encounter other sonic waves being reflected from surfaces within engine housing 10, thus reducing the total amount of sonic energy being emitted from engine housing 10.

Further noise reduction is accomplished by the use of sound absorption pads 88, which as shown in FIG. 2 are glued, or otherwise attached in a conventional and well known manner to the undersides of vent panels 28 and 30 as well as the interior surfaces of the enclosure with engine housing 10 in which the engine 68 and power source 70 are located.

As previously stated, enclosure baffle 58 is provided to prevent recirculation of air within engine housing 10. The use of enclosure baffle 58 insures the only source of cooling air is through air induction vent hole 80 and that the only vent hole through which hot air can be exhausted is through hot air exhaust vent hole 86. In the preferred embodiment engine 68 receives its supply of combustion air through air filter 76 which draws air through combustion air intake line 78 which passes through dividing wall 60. Engine exhaust air, passing through exhaust pipe 72, also passes through dividing wall 60 into muffler 74 and out through base plate 42 to atmosphere. It should be apparent that other configurations for inducting combustion air and discharging of engine exhaust air could be used without altering the inventive concepts of the present invention.

Cooling air, in the preferred embodiment, is drawn through air induction vent hole 80 and dividing wall vent hole 82 by means of cooling air fan 84. The representational engine shown in FIG. 2 would be an air cooled engine, and thus no radiator is shown. However it should be apparent to those skilled in the art that if engine 68 were to be a liquid cooled engine, then a radiator, or coolant heat exchanger would be included, preferably positioned to encounter air flowing through dividing wall vent hole 82.

Again referring to FIG. 1, my new noise reducing trailerable engine housing 10 is shown incorporated into trailerable light tower 8. Longitudinal beam 66 is attached to the upper surface of base plate 42 and base plate tongue extension 46, and passes entirely through engine housing 10. It serves both as the main structural member of the tongue assembly and also as a receiving member for rear jack extension 108 and tongue jack extension 90. In a similar fashion, outrigger receiving beams 100 are provided for use with outrigger jack assemblies 102. Each of the outrigger jack assemblies and the tongue and rear jack assemblies can be selectively retracted or extended, and locked in place by means of extension lock assemblies 110 which are of conventional and well known design.

Telescoping light tower 92 is provided together with lights 94. Telescoping light tower 92 is supported in its vertical position by means of light tower brace 96 and light tower support brackets 98 which are welded to first end wall 22 and base plate tongue extension 46 and thus become an integral part of the unibody constructed unit.

The use of the unibody construction, in practice, reduces the center of gravity by between two to four inches over where it would be located in a conventional prior art trailer platform frame were to be used. This reduction in the center of gravity, together with outrigger, tongue and rear jack assemblies, provides for a stable light tower capable of remaining upright even in high wind conditions.

While there is shown and described the present preferred embodiment of the invention, it is to be distinctly understood that this invention is not limited thereto but may be variously embodied to practice within the scope of the following claims.

I claim:

1. An engine housing for a heat and noise emitting engine which comprises:

a pair of top panels, each configured in size and shape to, in combination and in reciprocally angled relationship, span and cover an open topped container of predetermined length and width and to extend, in overhanging relationship a portion of each top panel over a side wall;

an open topped container, of predetermined length, width and volume, for receiving a heat and noise emitting engine, formed of a first pair of generally opposing end walls, defining a container length and a container centerline between them, a pair of generally opposing side walls defining a container width and a transverse axis between them, and a bottom plate, all interconnected to form said open topped container, said pair of generally opposing end walls each having a similar and pyramidally shaped upper portion for supporting the pair of said top panels spanning and covering the length of the enclosure in reciprocally angled orientations from a higher centerline peak to a lower point wherein a portion of each of said top panels overhangs one of the pair of opposing side walls, said pair of generally opposing side walls each having a vent hole located therein and configured in size and shape to provide that any line drawn parallel to the transverse axis and passing through a vent hole will intersect with the portion of a top panel which overhangs the side wall in which said hole is formed;

an enclosure baffle for, in combination with at least a portion of a side wall, dividing the container volume into two separate enclosures, with each having, as a part of its enclosure structure a portion of a side wall having a vent hole, said enclosure baffle having a baffle vent hole formed therethrough for the passage of air from one enclosure to the other within the container; and means for mounting a heat and noise emitting engine mounted within one of the enclosures.

2. The engine housing of claim 1 which further comprises means for holding each vent panel in predetermined angled spaced relationship to the pyramidal side edges of the opposing end walls.

3. The engine housing of claim 2 wherein the means for holding each vent panel in predetermined angled spaced relationship to the pyramidal side edges of the opposing end walls further comprises a plurality of vent panel extensions attached to and extending normally out from said vent panels for engagement with the pyramidal side edges of said opposing end walls.

4. The engine housing of claim 1 which further includes sound absorbing material covering the surfaces of the enclosure within which the means for mounting a heat and noise emitting engine is mounted.

5. The engine housing of claim 1 which further comprises:

a fan attached within the open topped container and operable to induct air from one enclosure to the other within said housing.

6. An engine housing for a heat and noise emitting engine which comprises:

a pair of vent panels, each configured in size and shape to, in combination and in reciprocally angled relationship, span and cover an open topped container of predetermined length and width and to extend, in overhanging relationship a portion of each top panel over a side wall;

a top panel configured in size and shape to span between and interconnect the horizontal frustrum portions of the top edges of a pair of opposing end walls;

an open topped container, of predetermined length, width and volume, for receiving a heat and noise emitting engine, formed of a first pair of generally opposing end walls, defining a container length and a container centerline between them, a pair of generally opposing side walls defining a container width and a transverse axis between them, and a bottom plate, all interconnected to form said open topped container, said pair of generally opposing end walls each having a similar and frustrum pyramidal shaped upper portion having a horizontally oriented top edge center portion for supporting a top panel and reciprocally angled pyramidal side edges for supporting the pair of vent panels spanning and covering the length of the enclosure in reciprocally angled orientations from a higher peak, parallel to the centerline axis to a lower point wherein a portion of each of said top panels overhangs one of the pair of opposing side walls, said pair of generally opposing side walls each having a vent hole located therein and configured in size and shape to provide that any line drawn parallel to the transverse axis and passing through a vent hole will intersect with the portion of a top panel which overhangs the side wall in which said hole is formed;

an enclosure baffle for, in combination with at least a portion of a side wall, dividing the container volume into two separate enclosures, with each having, as a part of its enclosure structure a portion of a side wall having a vent hole, said enclosure baffle having a baffle vent hole formed therethrough for the passage of air from one enclosure to the other within the container; and means for mounting a heat and noise emitting engine mounted within one of the enclosures.

7. The engine housing of claim 6 which further comprises means for holding each vent panel in predetermined angle spaced relationship to the pyramidal side edges of the opposing end walls.

8. The engine housing of claim 7 wherein the means for holding each vent panel in predetermined angled spaced relationship to the pyramidal side edges of the opposing end walls further comprises a plurality of vent panel extensions attached to and extending normally out from said vent panels for engagement with the pyramidal side edges of said opposing end walls.

9. The engine housing of claim 6 which further includes sound absorbing material covering the surfaces of the enclosure within which the means for mounting a heat and noise emitting engine is mounted.

10. The engine housing of claim 6 which further comprises:

a fan attached within the open topped container and operable to induct air from one enclosure to the other within said housing.

11. A self contained trailerable light tower, for transport by a towing vehicle, which comprises:

a pair of vent panels, each configured in size and shape to, in combination and in reciprocally angled relationship, span and cover an open topped container of predetermined length and width and to extend, in overhanging relationship a portion of each top panel over a side wall;

a top panel configured in size and shape to span between and interconnect the horizontal frustrum portions of the top edges of a pair of opposing end walls;

an open topped container, of predetermined length, width and volume, for receiving a heat and noise emitting engine, formed of generally opposing first and second end walls, defining a container length and a container centerline between them, a pair of generally opposing side walls defining a container width and a transverse axis between them, and a bottom plate, all interconnected to form said open topped container, said first and second generally opposing end walls each having a similar and frustrum pyramidal shaped upper portion having a horizontally oriented top edge center portion for supporting a top panel and reciprocally angled pyramidal side edges for supporting the pair of vent panels spanning and covering the length of the enclosure in reciprocally angled orientations from a higher peak, parallel to the centerline axis to a lower point wherein a portion of each of said top panels overhangs one of the pair of opposing side walls, said pair of generally opposing side walls each having a vent hole located therein and configured in size and shape to provide that any line drawn parallel to the transverse axis and passing through a vent hole will intersect with the portion of a top panel which overhangs the side wall in which said hole is formed;

an enclosure baffle for, in combination with at least a portion of a side wall, dividing the container volume into two separate enclosures, with each having, as a part of its enclosure structure a portion of a side wall having a vent hole, said enclosure baffle having a baffle vent hole formed therethrough for the passage of air from one enclosure to the other within the container;

means for mounting a heat and noise emitting engine mounted within one of the enclosures;

a heat and noise emitting engine mounted to said engine mounting means;

electrical power generation means operably connected to said heat and noise emitting engine;

a trailer axle and wheel assembly operably attached, in transverse alignment to the bottom plate;

a tongue assembly having a tongue extension beam, for operable attachment to a towing vehicle;

means for attaching the tongue extension beam to the bottom plate in an extending, in centerline alignment, orientation out from the first end wall;

a light tower assembly, having a plurality of lights thereon, for selectable vertical orientation;

a light tower brace, for selectively supporting the light tower assembly in a vertical orientation, attached to the first end wall; and means for operatively connecting said electrical power generation means to said light tower assembly.

12. The trailerable light tower assembly of claim 11 wherein the means for attaching the tongue extension beam to the bottom plate in an extending, in centerline alignment, orientation out from the first end wall comprises:

a longitudinal beam for telescopingly receiving, attached to the bottom plate in alignment parallel to the centerline; and latching means for locking said tongue extension beam to the longitudinal beam in selectable telescoping relationship.

* * * * *